US008702203B2

(12) United States Patent
Mizutani et al.

(10) Patent No.: US 8,702,203 B2
(45) Date of Patent: Apr. 22, 2014

(54) LIQUID JETTING APPARATUS

(75) Inventors: Hiromitsu Mizutani, Ichinomiya (JP); Shohei Koide, Nagoya (JP); Yusuke Suzuki, Nishio (JP); Atsushi Ito, Nagoya (JP); Mizuyo Takebayashi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 74 days.

(21) Appl. No.: 13/558,762

(22) Filed: Jul. 26, 2012

(65) Prior Publication Data

US 2013/0050319 A1 Feb. 28, 2013

(30) Foreign Application Priority Data

Aug. 31, 2011 (JP) ..... 2011-189462

(51) Int. Cl.
*B41J 23/00* (2006.01)
*B41J 29/38* (2006.01)

(52) U.S. Cl.
USPC ..... 347/37; 347/17

(58) Field of Classification Search
CPC ..... B41J 23/00; B41J 19/202
USPC ..... 347/8, 9, 12, 13, 17, 37, 42, 101, 104
See application file for complete search history.

(56) References Cited

U.S. PATENT DOCUMENTS 8,277,011 B2 * 10/2012 Suzuki ..... 347/14
8,297,741 B2 * 10/2012 Kirihara ..... 347/60
2010/0225694 A1 9/2010 Suzuki

FOREIGN PATENT DOCUMENTS

JP 2000-263768 9/2000
JP 2008-114411 5/2008
JP 2010/201790 9/2010

* cited by examiner

*Primary Examiner* — An Do
(74) *Attorney, Agent, or Firm* — Frommer Lawrence & Haug LLP

(57) ABSTRACT

A liquid jetting apparatus includes: a plurality of liquid jet heads each of which has a nozzle surface in which a plurality of nozzles are formed to align in one direction, a retention member which retains the plurality of liquid jet heads in a state of being arranged along one plane, a transport mechanism which transports a medium in a transport direction along the one plane, and a displacement mechanism which displaces the retention member in a specified direction toward one side along a direction intersecting the nozzle surfaces by curving the retention member or rotating the same in a rotation direction when the retention member extends due to temperature change on the one plane in an intersectant direction intersecting the transport direction.

11 Claims, 13 Drawing Sheets

LIQUID JETTING APPARATUS

CROSS REFERENCE TO RELATED APPLICATION

The present application claims priority from Japanese Patent Application No. 2011-189462, filed on Aug. 31, 2011, the disclosure of which is incorporated herein by reference in its entirety.

BACKGROUND OF THE INVENTION

1. Field of the Invention

The present invention relates to liquid jetting apparatuses including liquid jetting heads which jet liquids from nozzles.

2. Description of the Related Art

Japanese Patent Application Laid-Open No. 2008-114411 discloses a printer including head units (liquid jetting heads) each of which has a plurality of nozzles aligned in a paper width direction perpendicular to a direction of transporting printing paper. The head units are fixed on a base frame to align in a zigzag pattern along the paper width direction, thereby forming one line head unit. Then, printing is carried out on the printing paper by jetting ink from the plurality of nozzles of these plurality of head units onto the printing paper transported in the transport direction.

SUMMARY OF THE INVENTION

In the printer described above, the base plate will expand when the temperature of the base plate rises due to the rise of the environmental temperature and the like. At the time, the base plate also extends in the paper width direction perpendicular to the transport direction. As the base plate extends in the paper width direction, the nozzles positionally deviate in the paper width direction among the head units. When printing is carried out under this condition, then the landing position of ink on the printing paper may also deviate in the paper width direction. As a result, portions with no ink landed arise in the printing area on the printing paper, thereby reducing the print quality such as streaks extending in the transport direction come up in the printed image, and the like. Further, the above-mentioned printer carries out printing by jetting ink onto the printing paper transported in the transport direction from the plurality of nozzles of the fixed head units. Therefore, even when the timing of jetting ink from the nozzles, and the like is adjusted, it is still not possible to correct the ink landing position in the paper width direction.

Accordingly, an object of the present invention is to provide a liquid jetting apparatus capable of diminishing a positional deviation of the nozzles among the liquid jet heads in a direction intersecting the direction of transporting a jet object in the case of temperature rise and the like.

According to an aspect of the present invention, there is provided a liquid jetting apparatus which jets a liquid onto a medium, including:

- a plurality of liquid jetting heads each of which has a nozzle surface in which a plurality of nozzles are formed to align in one direction;
- a holding member which is configured to hold the plurality of liquid jetting heads in a state of being arranged along one plane;
- a transport mechanism which is configured to transport the medium in a transporting direction along the one plane; and
- a displacement mechanism which is configured to displace the holding member in a specified direction which is one side in a direction intersecting the nozzle surfaces by curving the holding member or by rotating the holding member, under a condition that the holding member extends due to temperature change on the one plane in an intersecting direction intersecting the transporting direction.

According to the liquid jetting apparatus of the present invention, when the holding member has extended due to temperature change in an intersecting direction intersecting the transporting direction on one plane, because the holding member is displaced in a specified direction intersecting the nozzle surfaces, the deviation of the nozzles among the liquid jetting heads is diminished in the intersecting direction when the holding member has extended due to temperature change.

Further, according the present invention, because the position of the nozzles is displaced in the specified direction, although deviation occurs in the landing position of the liquid jetted from the nozzles onto an object, this deviation in landing position is smaller in the intersecting direction than that due to the positional deviation of the nozzles among the liquid jet heads. Further, it is also possible to correct the deviation by adjusting the timing of jetting the liquid from the nozzles, and the like.

DESCRIPTION OF THE PREFERRED EMBODIMENTS

First Embodiment

Hereinbelow, a first embodiment in accordance with the present invention will be explained.

Figure 1:
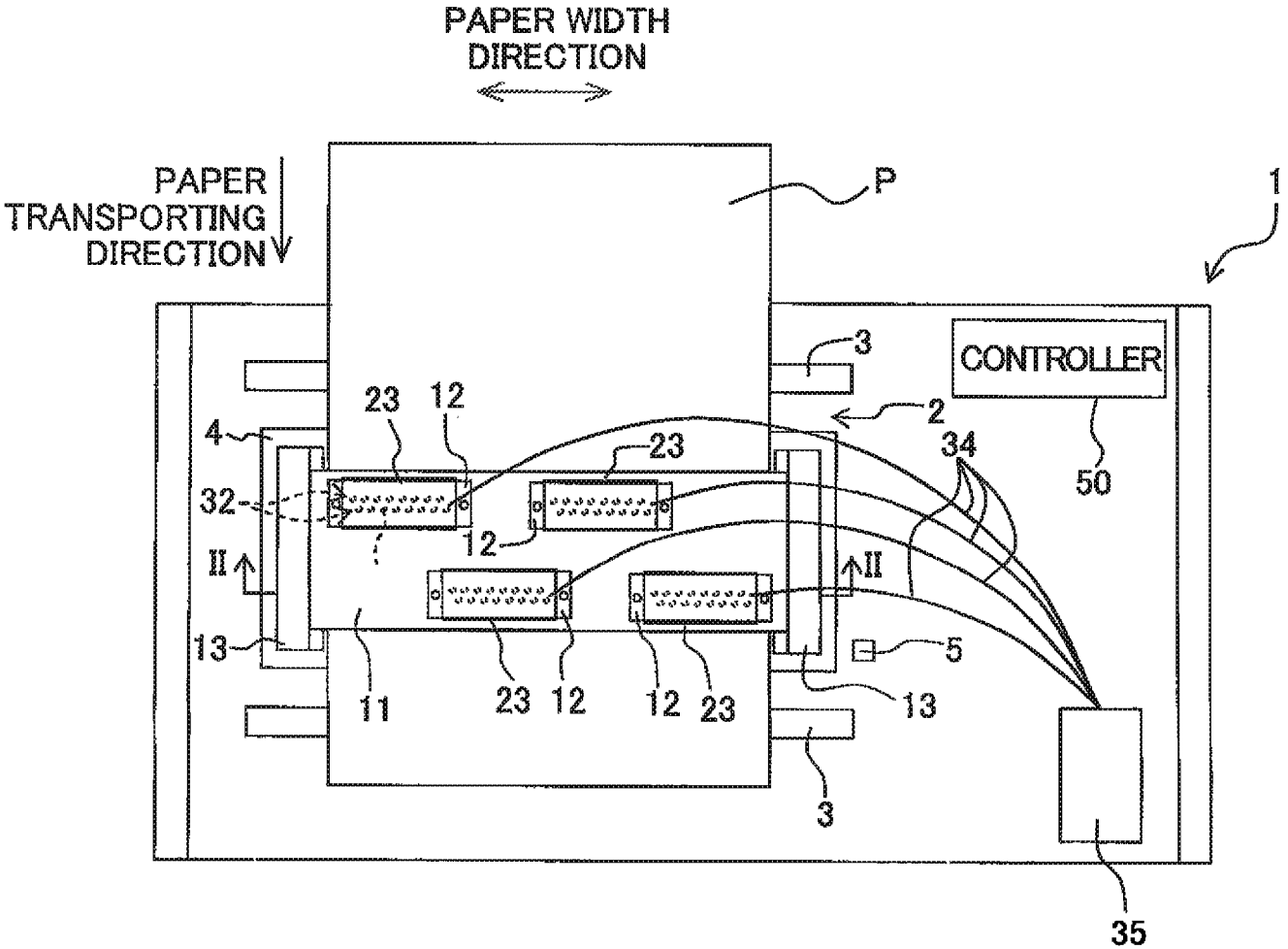
FIG. 1 is a schematic configuration diagram of a printer as an example of the liquid jetting apparatus in accordance with a first embodiment of the present teaching.

As shown in FIG. 1, a printer 1 (a liquid jetting apparatus) in accordance with the first embodiment includes a head unit 2, paper transporting rollers 3 (a transporting mechanism), a platen 4 (a supporting member), a temperature sensor 5 (a temperature sensor), and the like. Further, a controller 50 controls operations of the printer 1.

The head unit 2 is a so-called line head which jets inks (liquids) from a plurality of nozzles 31 formed in the lower surface of the head unit 2. The paper transporting rollers 3 are arranged respectively above and below the head unit 2 in FIG. 1 to transport a recording paper P in a horizontal paper feeding direction (downward in FIG. 1). The platen 4 is arranged under the head unit 2 to support the recording paper P being transported by the paper transporting rollers 3 from below on the portion facing the head unit 2. The temperature sensor 5 is arranged in the vicinity of the head unit 2 to detect the temperature of the head unit 2 (or an environmental temperature in the vicinity of the head unit 2). Further, the temperature sensor 5 may not necessarily be arranged in the vicinity of the head unit 2 to detect the temperature of the head unit 2 or the environmental temperature in the vicinity of the head unit 2. It may as well detect the temperature of a member away from the head unit 2 in so far as correlated with the temperature of the head unit 2.

Then, the printer 1 carries out printing on the recording paper P by jetting the inks from the plurality of nozzles 31 of the head unit 2 onto the recording paper P being transported by the paper transporting rollers 3 and supported by the platen 4 from below.

Figure 2A:
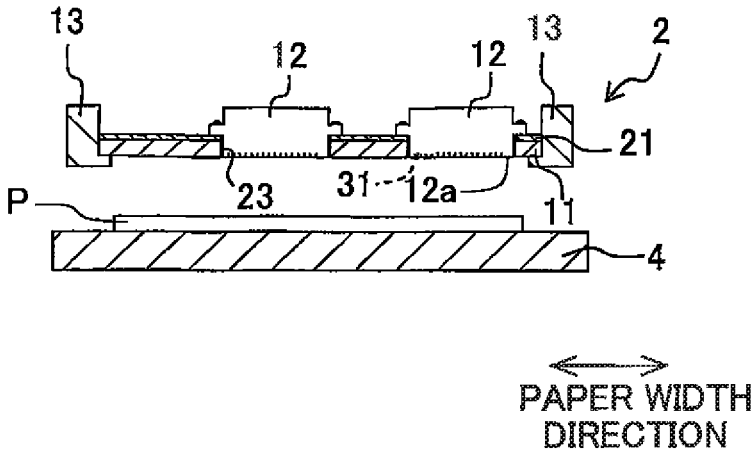
FIG. 2A is a cross-sectional view taken along the line II-II of FIG. 1, showing a head holding plate in a non-curved state.
Figure 2B:
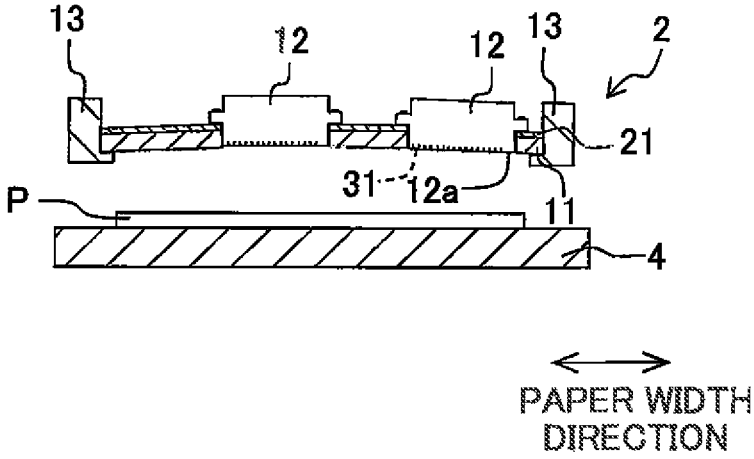
FIG. 2B is another cross-sectional view taken along the line II-II of FIG. 1, showing the head holding plate in a curved state.

Next, the head unit 2 will be explained in detail. As shown in FIGS. 1, 2A and 2B, the head unit 2 includes a head holding plate 11 (a holding member), four ink-jet heads 12 (liquid jetting heads), and a pair of restriction members 13.

The head holding plate 11 is an approximately rectangular plate-shaped member formed of a metallic material and the like, and is arranged to be parallel to the horizontal plane so that a longitudinal direction thereof is substantially parallel to a paper width direction perpendicular to the paper feeding direction (the horizontal direction in FIG. 1). Further, four approximately rectangular through holes 23 are formed in the head holding plate 11 so that the longitudinal directions thereof is substantially parallel to the paper width direction, respectively, and that the through holes 23 are aligned in a zigzag pattern along the paper width direction. Further, a high expansion member 21 is adhered on the upper surface of the head holding plate 11 over the entire area. The high expansion member 21 is made of a material with a linear expansion coefficient higher than that of the head holding plate 11 such as a metal (stainless steel, copper, aluminum, and the like).

A plurality of nozzles 31 are formed in each of nozzle surfaces 12*a* which are the lower surfaces of the four ink-jet heads 12, and inks (liquids) are jetted from these plurality of nozzles 31. Further, the plurality of nozzles 31 in each of the ink-jet head 12 are aligned in a zigzag pattern along the paper width direction (a predetermined direction) to form two nozzle arrays 32. Then, the four ink-jet heads 12 of such configuration are fixed on the upper surface of the head holding plate 11 such that the nozzle surfaces 12*a* are exposed from the four through holes 23.

Further, the four ink-jet heads 12 are connected to ink cartridges 35 through tubes 34, respectively. The ink cartridges 35 supply the ink-jet heads 12 with the inks to be jetted from the plurality of nozzles 31.

The pair of restriction members 13 are formed of a material with a linear expansion coefficient lower than that of the high expansion member 21 and that of the head holding plate 11 such as alumina, glass, ceramics and the like. The pair of restriction members 13 are arranged to sandwich the head holding plate 11 from the paper width direction.

Figure 3:
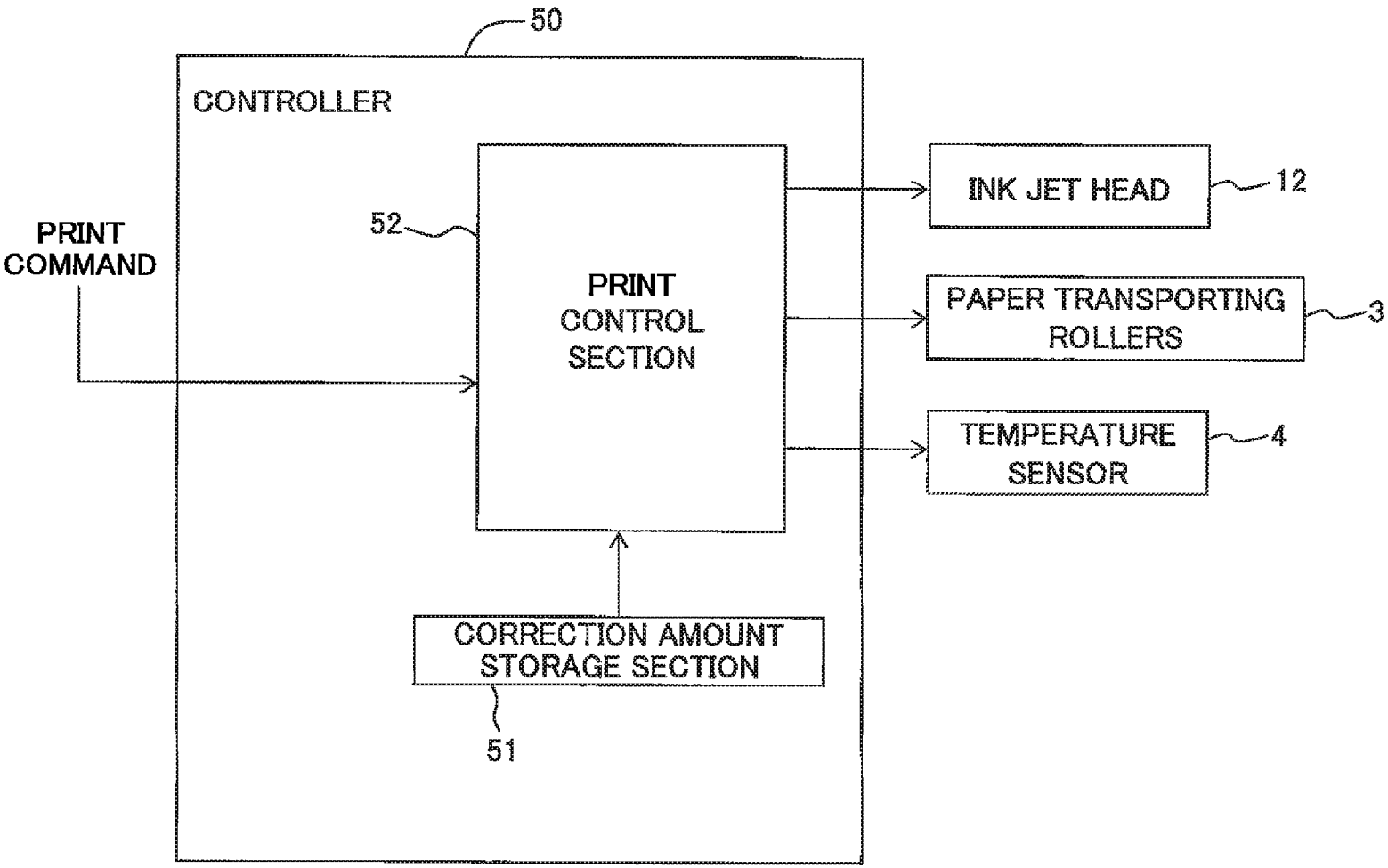
FIG. 3 is a functional block diagram of a control device of the printer of FIG. 1.

Next, explanations will be made with respect to the controller 50 controlling operations of the printer 1. The controller 50 includes a Central Processing Unit (CPU), a Read Only Memory (ROM), a Random Access Memory (RAM), and the like. As shown in FIG. 3, these components operate as a correction amount storage portion 51 and a print control portion 52, respectively.

The correction amount storage portion 51 stores a data providing a relationship between the temperature of the head holding plate 11 and the correction amount of the jet timing. Alternatively, the correction amount storage portion 51 can store a data providing a relationship between the correction amount of the jet timing and the temperature of a place (or a member) correlated with the temperature of the head holding plate 11 such as an environmental temperature in the vicinity of the head holding plate 11. The print control portion 52 controls the operation of the ink-jet heads 12 when the printer 1 carries out printing. In particular, the print control portion 52 reads out the correction amount of the jet timing from the correction amount storage portion 51 based on the temperature detected by the temperature sensor 5, and controls the ink-jet heads 12 so that the inks are jetted from the nozzles 31 at a time advanced to be earlier by the read-out correction amount than that in the case of not carrying out correction (adjusts the jet timing). Further, in the first embodiment, the combination of the correction amount storage portion 51 and the print control portion 52 corresponds to a jet timing adjustment mechanism in accordance with the present teaching. Further, the print control portion 52 also controls the operation of the paper transport rollers 3, and the like.

Then, in the printer 1 having such a configuration as explained hereinabove, when the temperature of the head holding plate 11 rises due to a change in the environmental temperature and the like, the head holding plate 11 is subjected to expansion. At this time, if by assumption the restriction members 13 are not provided, then the expanding head holding plate 11 also extends in the paper width direction (the intersectant direction) and, as a result, the intervals of the nozzles 31 increase in the paper width direction among the plurality of ink-jet heads 12. Further, if the intervals of the nozzles 31 increase in the paper width direction among the plurality of ink-jet heads 12, then when the printer 1 carries out printing, streak-like portions with no ink landed on the recording paper P come up to extend in the paper feeding direction, thereby leading to reduction of the print quality. Further, it is not possible to correct such deviation of the nozzles 31 in the paper width direction as described hereinabove even by adjusting the timing of jetting the inks from the nozzles 31, and the like.

In contrast to the above situation, in the printer 1 in accordance with the first embodiment, the pair of restriction members 13 are arranged to sandwich the head holding plate 11 from the paper width direction. Therefore, the head holding plate 11 under expansion due to temperature rise is regulated from being extended in the paper width direction, and thereby undergoes a curvature. Further, as this time, because the high expansion member 21 with a linear expansion coefficient higher than that of the head holding plate 11 is adhered on the upper surface of the head holding plate 11, the head holding plate 11 under expansion due to temperature rise is curved to be convex upward as shown in FIG. 2B. In other words, the head holding plate 11 under expansion due to temperature rise is displaced to be convex toward the opposite side against the direction of jetting the inks from the nozzles 31. Further, in the first embodiment, the high expansion member 21 adhered on the upper surface of the head holding plate 11 corresponds to a directing mechanism in accordance with the present teaching. Further, the combination of this directing mechanism and the restriction members 13 corresponds to a displacement mechanism in accordance with the present teaching.

That is, the directing mechanism of the first embodiment serves to promote a deformation such that the displacement of the head holding plate 11 may arise toward only one side along a specified direction defined either in the ink jet direction or in the opposite direction.

By virtue of this, when the head holding plate 11 has expanded due to temperature rise, no deviation of the nozzles 31 may occur in the paper width direction among the ink-jet heads 12. Therefore, it is possible to prevent the print quality from reduction.

Further, at that time, because the head holding plate 11 curves in a direction away from the recording paper P, there is no fear that the curved head holding plate 11 may contact with the recording paper P and thus cause damage to the nozzle surfaces 12*a*.

Here, when the head holding plate 11 is curved in a direction away from the recording paper P, the position of each nozzle 31 of the ink-jet heads 12 is displaced upward, and thereby the interspace between the nozzles 31 and the recording paper P increases. However, when the interspace between the nozzles 31 and the recording paper P is altered, then the ink landing position on the recording paper P deviates in the paper feed direction. Therefore, differing from the case that the intervals of nozzles 31, increase in the paper width direction, there is no fear that streak-like portions with no ink landed on the recording paper P may come up to extend in the paper feed direction.

Accordingly, the reduction in print quality due to the curvature of the head holding plate 11 is smaller compared with the case that the intervals of the nozzles 31 are altered in the paper width direction.

Further, based on a detection result obtained by a mechanism detecting the amount of displacement of the head holding plate 11, it is possible to adjust the jet timing of the inks from the nozzles 31. For example, it is possible to adopt the temperature detected by the temperature sensor 5 as the detection result. In this case, it is possible to correct the ink landing position in the paper feed direction by adjusting the jet timing of the inks from the nozzles 31 when the head holding plate 11 is curved due to temperature rise so as to bring about a larger distance between the nozzles 31 and the recording paper P.

At this time, because the head holding plate 11 is curved to be convex upward definitely, by advancing the jet timing of the inks from the nozzles 31 according to the temperature detected by the temperature sensor 5, it is possible to reliably correct the ink landing position.

Second Embodiment

Next, a second embodiment of the present teaching will be explained. Note that, however, explanations will be made hereinbelow with respect to the difference from the first embodiment, and be omitted as appropriate with respect to the constitutive parts or components which are the substantially same as or substantially equivalent to those of the first embodiment.

Figure 4A:
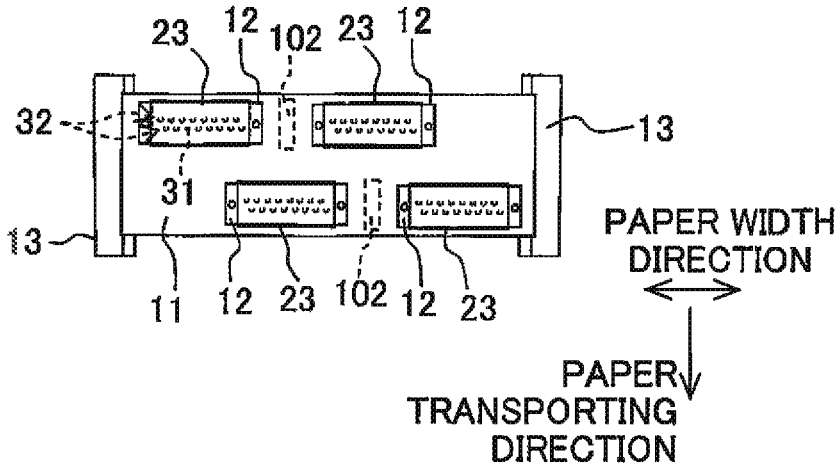
FIG. 4A is a plane view of a head unit in accordance with a second embodiment of the present invention.
Figure 4B:
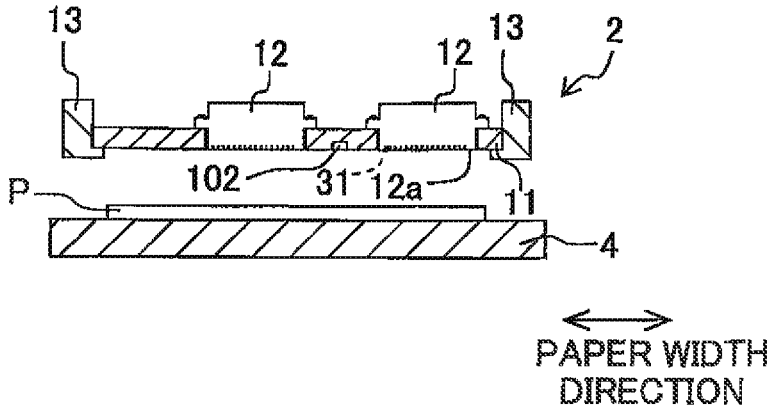
FIG. 4B is a cross-sectional view corresponding to FIG. 2A of the head unit in accordance with the second embodiment.
Figure 4C:
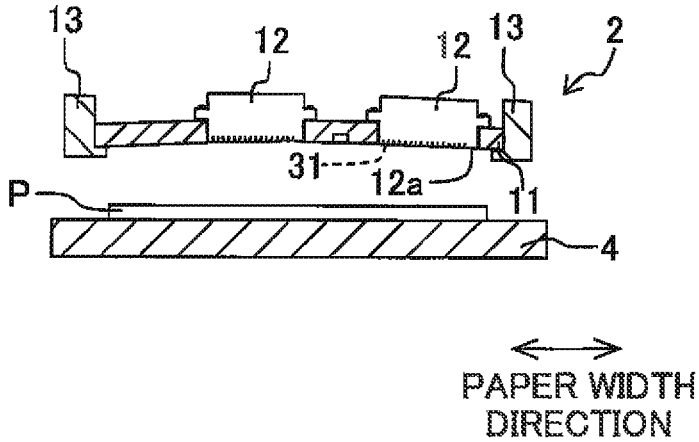
FIG. 4C is a cross-sectional view corresponding to FIG. 2B of the head unit in accordance with the second embodiment.

In a head unit 101 in accordance with the second embodiment as shown in FIGS. 4A to 4C, the high expansion member 21 (see FIGS. 2A and 2B) is not adhered on the upper surface of the head holding plate 11 but, instead, recesses 102 are formed in the lower surface of the head holding plate 11 (the surface on the opposite side against the specified direction) between the adjacent ink-jet heads 12 in the paper width direction, respectively.

Then, in the second embodiment, because the recesses 102 are formed in the lower surface of the head holding plate 11, it is easy for the head holding plate 11 to convexly curve upward. Thereby, the head holding plate 11 under expansion due to temperature rise is curved to be convex upward definitely. Further, in the second embodiment, the recesses 102 formed in the lower surface of the head holding plate 11 correspond to the directing mechanism in accordance with the present teaching. At the time, however, differing from the first embodiment, it is possible for the head holding plate 11 to achieve the displacement along the specified direction only through a process to form the recesses, without the necessity to attach a different material to the upper or lower surface of the head holding plate 11, thereby contributing to miniaturization of the head unit in its thickness direction.

Third Embodiment

Next, a third embodiment of the present teaching will be explained. Note that, however, explanations will be made hereinbelow with respect to the differences from the first and second embodiments, and be omitted as appropriate with respect to the constitutive parts or components which are the substantially same as or substantially equivalent to those of the first and second embodiments.

Figure 5A:
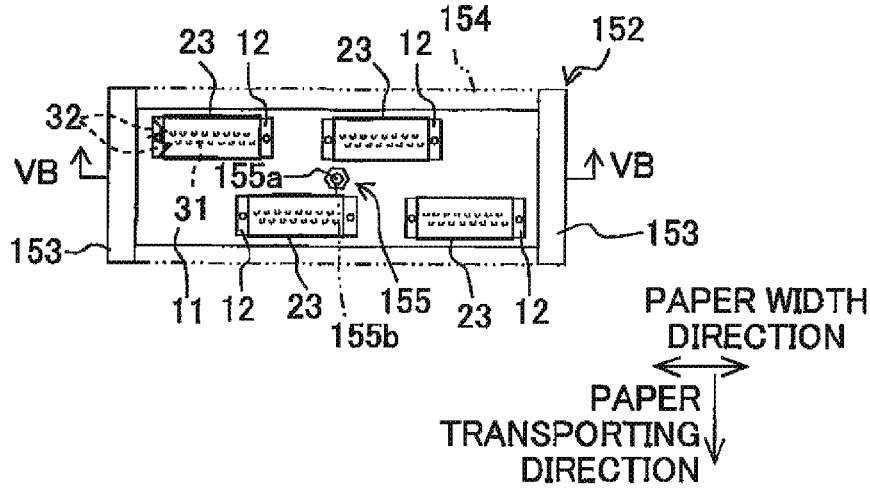
FIG. 5A is a plane view of a head unit in accordance with a third embodiment of the present invention.
Figure 5B:
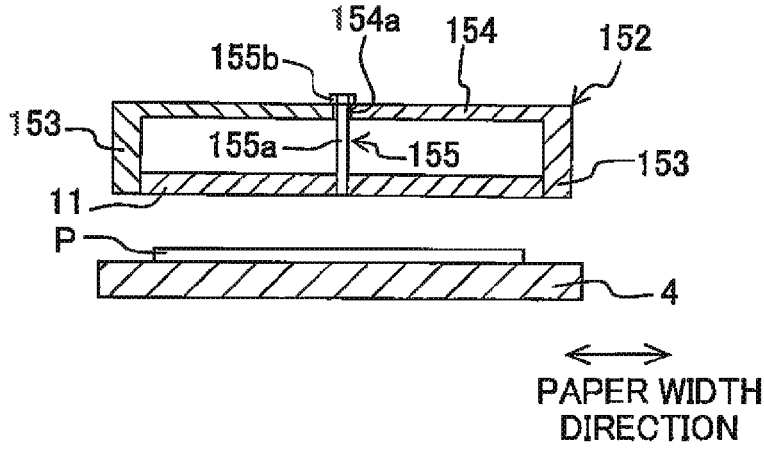
FIG. 5B is a cross-sectional view taken along the line VB-VB of FIG. 5A, showing a head holding plate in a non-curved state.
Figure 5C:
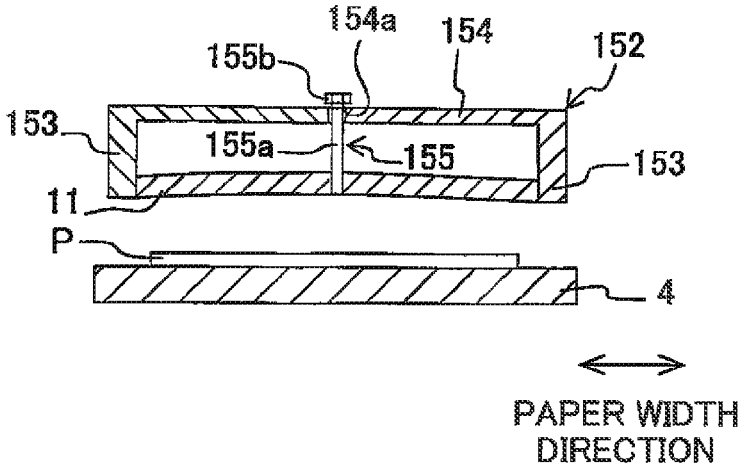
FIG. 5C is another cross-sectional view taken along the line VC-VC of FIG. 5A, showing the head holding plate in a curved state.

In a head unit 151 in accordance with the third embodiment as shown in FIGS. 5A to 5C, a regulatory frame 152 is provided instead of the pair of restriction members 13 (see FIGS. 2A and 2B), and includes a pair of restriction portions 153 (restriction members) and a connection portion 154 (a fixation member).

The pair of restriction portions 153 are arranged to sandwich the head holding plate 11 from the paper width direction and, in analogy with the restriction members 13, to regulate the head holding plate 11 under expansion due to temperature rise from extension in the paper width direction. The connection portion 154 is arranged above the head holding plate 11 to face the head holding plate 11, connecting both upper-end portions of the pair of restriction portions 153.

Further, a through hole 154*a* is formed in the approximately central portion of the connection portion 154 in plane view, and a rod 155*a* of a bolt 155 (a rod-like member) extending in a vertical direction is inserted through the through hole 154*a*. The rod 155*a* is smaller in diameter than the through hole 154*a*, and movable along the through hole 154*a* in the vertical direction. Further, the lower end of the rod 155*a* is fastened and fixed into the approximately central portion of the head holding plate 11. Further, on the upper end of the rod 155*a*, a head 155*b* larger in diameter than the through hole 154*a* is provided to contact with the upper surface of the connection portion 154. Then, because the through hole 154*a* is formed in the approximately central portion of the connection portion 154, the head 155*b* contacts with a portion of the upper surface of the connection portion 154 to be the point-symmetric center of the plurality of heads in plane view.

In this case, then, when the head holding plate 11 under expansion due to temperature rise is curved to be convex upward as shown in FIG. 5C, the bolt 155 fastened into the head holding plate 11 moves upward integrally with the head holding plate 11.

On the other hand, the head 155*b* of the bolt 155 is in contact with the upper surface of the connection portion 154. Therefore, even if the head holding plate 11 under expansion due to temperature rise tends to convexly curve downward, it cannot move downward, thereby restricting the head holding plate 11 fastened with the bolt 155 from convexly curving downward.

That is, the directing mechanism in the third embodiment is different from that in the first embodiment in that it restricts the head holding plate 11 from deformation toward the opposite side against the specified direction such that the displacement of the head holding plate 11 arises toward only one side along the specified direction defined either in the ink jet direction or in the opposite direction.

From the above description, the head holding plate 11 under expansion due to temperature rise is curved to be convex upward definitely. Further, when the bolt 155 is further tightened with the head 155*b* in contact with the upper surface of the connection portion 154, then the head holding plate 11 is pulled upward by the fastening force of the bolt 155. That is the bolt 155 can exert a force on the head holding plate 11 to curve it convexly in an upward direction. Therefore, when the bolt 155 is tightened to exert the abovementioned force on the head holding plate 11, then the head holding plate 11 under expansion due to temperature rise is curved to be convex upward definitely.

Further, the more the bolt 155 is tightened, the more this force becomes. Therefore, by adjusting the fastening force of the bolt 155, it is possible to adjust the amount of curvature of the head holding plate 11 under expansion due to temperature rise. That is, the bolt 155 serves as an adjustment member to adjust the amount of displacement of the head holding plate 11 along the specified direction. Further, in the third embodiment, the combination of the connection portion 154 and the bolt 155 corresponds to the directing mechanism in accordance with the present teaching.

Further, when adjusting the jet timing of the inks from the nozzles 31 to correct the ink landing position in the paper feeding direction, it is possible to adjust the jet timing according to the temperature change and the extent of tightening the bolt 155.

Further, in the third embodiment, although a screw (the bolt 155) is used as a restriction mechanism in the fastening to adjust the amount of deformation, it is not necessary to form any screw thread if the amount of deformation is not to be adjusted. That is, it is also possible to restrict the head holding plate 11 from deformation by fitting a rod-like member into the through hole 154*a* and the head holding plate 11 while retaining or fixing the rod-like member to the head holding plate 11 on the portion corresponding to the head 155*b*.

Next, explanations will be made with respect to modifications applying various changes to the first, second, and third embodiments. Note that, however, explanations will be omitted as appropriate with respect to the constitutive parts or components which are the substantially same as or substantially equivalent to those of the first, second, and third embodiments.

In the first embodiment, the high expansion member 21 with a linear expansion coefficient higher than that of the head holding plate 11 is agglutinated on the upper surface of the head holding plate 11. By virtue of this, the head holding plate 11 under expansion due to temperature rise is curved to be convex upward. However, the present teaching is not limited to such configuration.

Figure 6A:
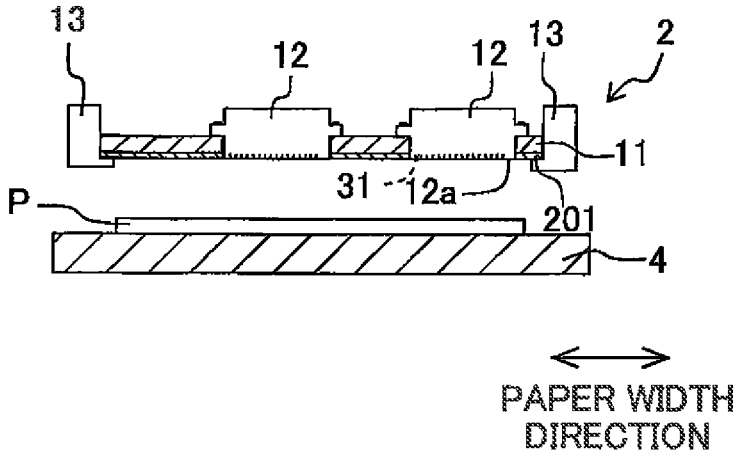
FIG. 6A is a view corresponding to FIG. 2A in accordance with a first modification.

In a first modification as shown in FIG. 6A, instead of providing the high expansion member 21 (see FIGS. 2A and 2B) on the upper surface of the head holding plate 11, a low expansion member 201 with a linear expansion coefficient lower than that of the head holding plate 11 is adhered on the lower surface of the head holding plate 11. The low expansion member 201 is made of, for example, alumina, glass, ceramics, and the like.

Figure 6B:
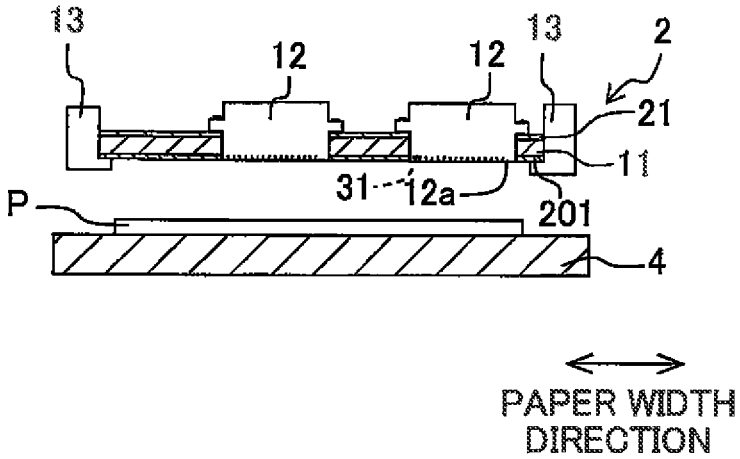
FIG. 6B is a view corresponding to FIG. 2A in accordance with a second modification.

Further, in a second modification as shown in FIG. 6B, the high expansion member 21 is adhered on the upper surface of the head holding plate 11 and, furthermore, the low expansion member 201 described hereinabove is adhered on the lower surface of the head holding plate 11.

In these cases, when the head holding plate 11 is expanding due to temperature rise, in the same manner as in the first embodiment, the head holding plate 11 is also curved to be convex upward definitely due to the difference in linear expansion coefficient between the high expansion member 21 and the low expansion member 201. Further, in the first modification, the low expansion member 201 corresponds to the directing mechanism in accordance with the present teaching, while in the second modification, the combination of the high expansion member 21 and the low expansion member 201 corresponds to the directing mechanism in accordance with the present teaching.

Figure 7A:
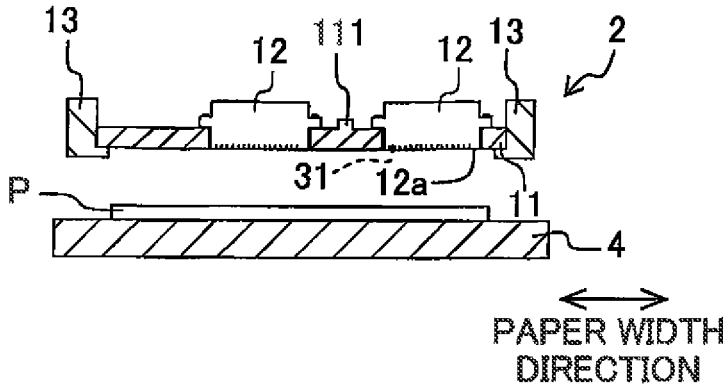
FIG. 7A is a view corresponding to FIG. 4A in accordance with a third modification.

Further, in the second embodiment, although the recesses 102 are formed in the lower surface of the head holding plate 11, the present teaching is not limited to such configuration. In a third modification as shown in FIG. 7A, instead of the recesses 102 (see FIGS. 4A to 4C), projections 111 are formed on the upper surface of the head holding plate 11 between two adjacent ink-jet heads 12 in the paper width direction (on the side along the specified direction), respectively.

In this case, because the projections 111 are formed on the upper surface of the head holding plate 11, it is difficult for the head holding plate 11 to convexly curve downward. Thereby, the head holding plate 11 under expansion due to temperature rise is curved to be convex upward definitely. Further, in this case, the projections 111 correspond to the directing mechanism in accordance with the present teaching.

Figure 7B:
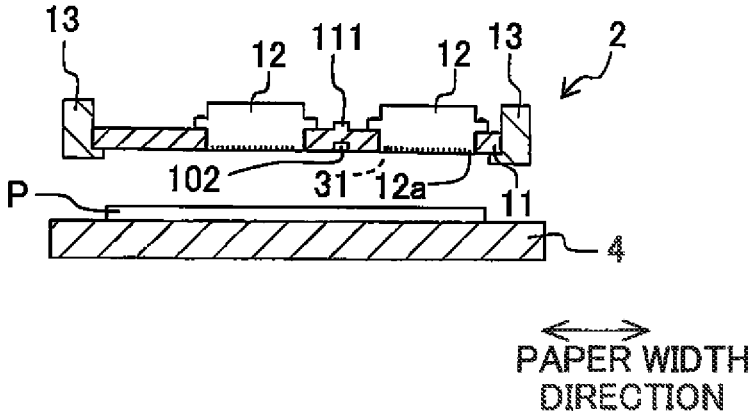
FIG. 7B is a view corresponding to FIG. 4A in accordance with a fourth modification.

Further, in the third modification, the projections 111 are formed instead of the recesses 102. However, in a fourth modification as shown in FIG. 7B, the projections 111 are formed on the upper surface of the head holding plate 11 in addition to the recesses 102 formed in the lower surface of the head holding plate 11. Further, in this case, the combination of the recesses 102 and the projections 111 corresponds to the directing mechanism in accordance with the present teaching.

Further, the recesses 102 and the projections 111 are not limited to being formed in the portions of the head holding plate 11 between two adjacent ink-jet heads 12 in the paper width direction, but may as well be formed in other portions of the upper surface and the lower surface of the head holding plate 11.

Further, in the third embodiment, the bolt 155 is fastened into the approximately central portion of the head holding plate 11. However, the present teaching is not limited to such configuration. For example, the bolt 155 may as well be fastened into other portions of the head holding plate 11.

Further, in the first, second, and third embodiments, the ink landing position, which is deviated by change in the distance between the nozzles 31 and the recording paper P due to the curvature of the head holding plate 11, is corrected by adjusting the jet timing of the inks from the nozzles 31. However, the present teaching is not limited to such configuration.

Figure 8A:
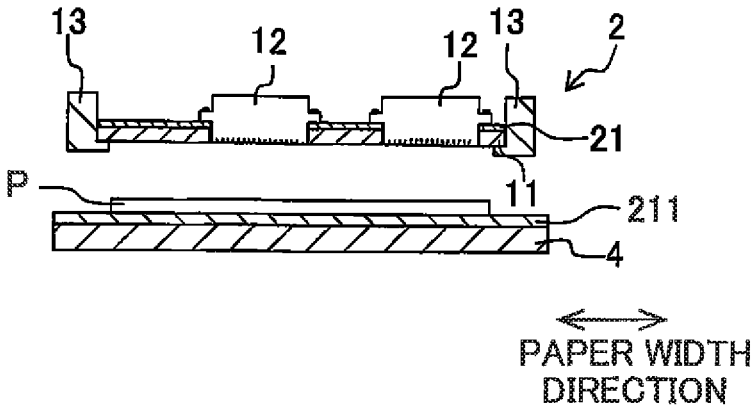
FIG. 8A is a view of a head unit corresponding to FIG. 2A in accordance with a fifth modification.
Figure 8B:
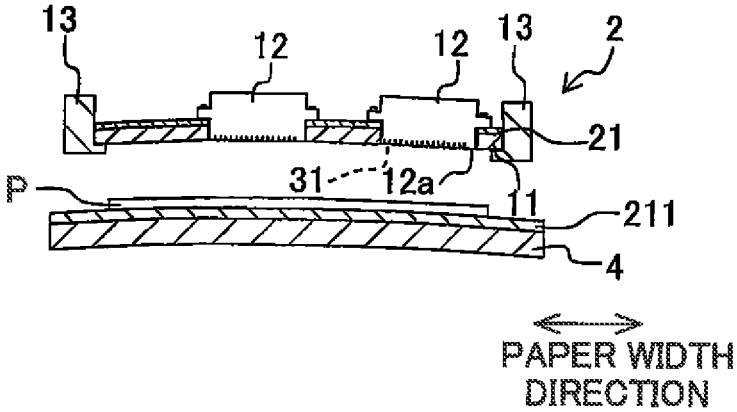
FIG. 8B is a view of the head unit corresponding to FIG. 2B in accordance with the fifth modification.

In a fifth modification as shown in FIG. 8A, the platen 4 described in the first embodiment is formed of the same material as that of the head holding plate 11. Further, a high expansion member 211 formed of the same material as that of the high expansion member 21 is adhered on the upper surface of the platen 4. In this case, as shown in FIG. 8B, when the head holding plate 11 is curved to be convex upward due to the difference from the high expansion member 21 in linear expansion coefficient, the platen 4 is also curved to be convex upward due to the difference from the high expansion member 211 in linear expansion coefficient. By virtue of this, before and after the head holding plate 11 is curved, an approximately invariant distance is maintained between the nozzles 31 and the recording paper P carried on the upper surface of the platen 4 (the high expansion member 211). Therefore, when the head holding plate 11 is curved and the nozzles 31 have changed position, it is possible to prevent the ink landing position from deviation. Further, in this case, the high expansion member 211 adhered on the upper surface of the platen 4 corresponds to a curvature mechanism in accordance with the present teaching.

Figure 9A:
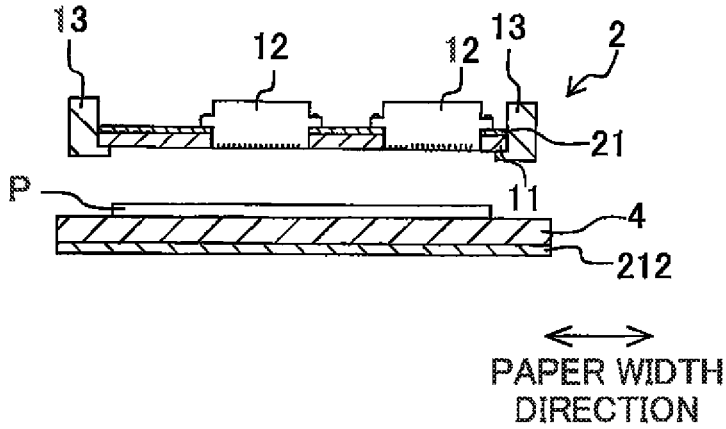
FIG. 9A is a view corresponding to FIG. 2A in accordance with a sixth modification.
Figure 9B:
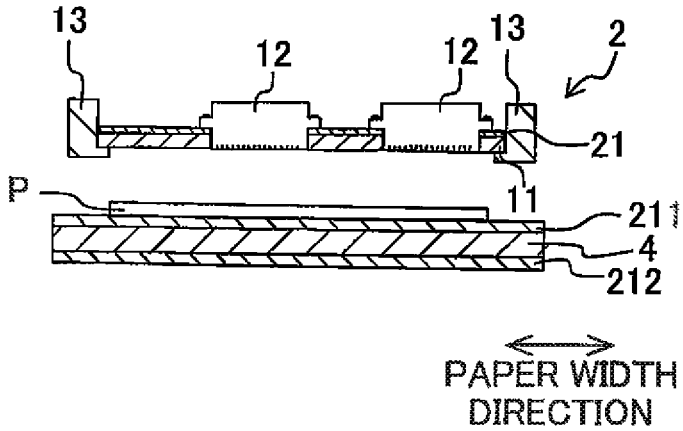
FIG. 9B is a view corresponding to FIG. 2A in accordance with a seventh modification.

Further, in the fifth modification, the high expansion member 211 is adhered on the upper surface of the platen 4. In contrast to this, in a sixth modification as shown in FIG. 9A, the high expansion member 211 is replaced by a low expansion member 212 which is made of the same material as that of the low expansion member 201 in the first modification, and adhered on the lower surface of the platen 4. Further, in a seventh modification as shown in FIG. 9B, the high expansion member 211 is adhered on the upper surface of the platen 4 and, furthermore, the low expansion member 212 is adhered on the lower surface of the platen 4. In this case, then, the platen 4 is also curved to be convex upward due to temperature rise in the same manner as in the fifth modification. Further, in the sixth modification, the low expansion member 212 corresponds to the curvature mechanism in accordance with the present teaching, while in the seventh modification, the combination of the high expansion member 211 and the low expansion member 212 corresponds to the curvature mechanism in accordance with the present teaching.

Further, although the platen 4 is formed of the same material as that of the head holding plate 11 in the fifth, sixth and seventh modifications, it is not limited to that material. Further, the high expansion member 211 adhered on the upper surface of the platen 4 and the low expansion member 212 adhered on the lower surface of the platen 4 may as well be formed of different materials from those of the high expansion member 21 and the low expansion member 201, respectively, as long as the magnitude relation relative to the linear expansion coefficient of the platen 4 is not changed.

Further, although the platen 4 is curved due to the difference in linear expansion coefficient from at least one of the high expansion member and the low expansion member in the fifth, sixth and seventh modifications, to curve the platen 4 is not limited to such configuration. The platen 4 may as well be curved by other configurations such as pressing the platen 4 from outside to curve the same, and the like.

Further, although in the fifth, sixth and seventh modifications, the head holding plate 11 is curved by the same configuration as in the first embodiment, it may as well be curved by other configurations such as the same configurations as in the second and third embodiments, and the like.

Further, in the above examples, when the head holding plate 11 is curved, the landing position is prevented from deviation due to the change in distance between the nozzles 31 and the recording paper P. For this purpose, the landing position is corrected by adjusting the jet timing of the inks from the nozzles 31, or the platen 4 is curved. However, such kind of correction of the landing position may not necessarily be carried out.

In this case too, as described hereinbefore, the reduction in print quality due to the curvature of the head holding plate 11 is smaller than that when the intervals of the nozzles 31 become larger in the paper width direction. Therefore, even without correcting the deviation of landing position by adjusting the jet timing as described hereinabove, the print quality will not be reduced to so great a degree.

Further, the restriction members 13 and the restriction frame 152 are arranged to sandwich the head holding plate 11 from the paper width direction perpendicular to the paper feed direction in the first, second and third embodiments. However, the present teaching is not limited to such configuration. For example, the restriction members 13 and the restriction frame 152 may as well be arranged to sandwich the head holding plate 11 from a direction intersecting the paper feeding direction other than the paper width direction.

Figure 10:
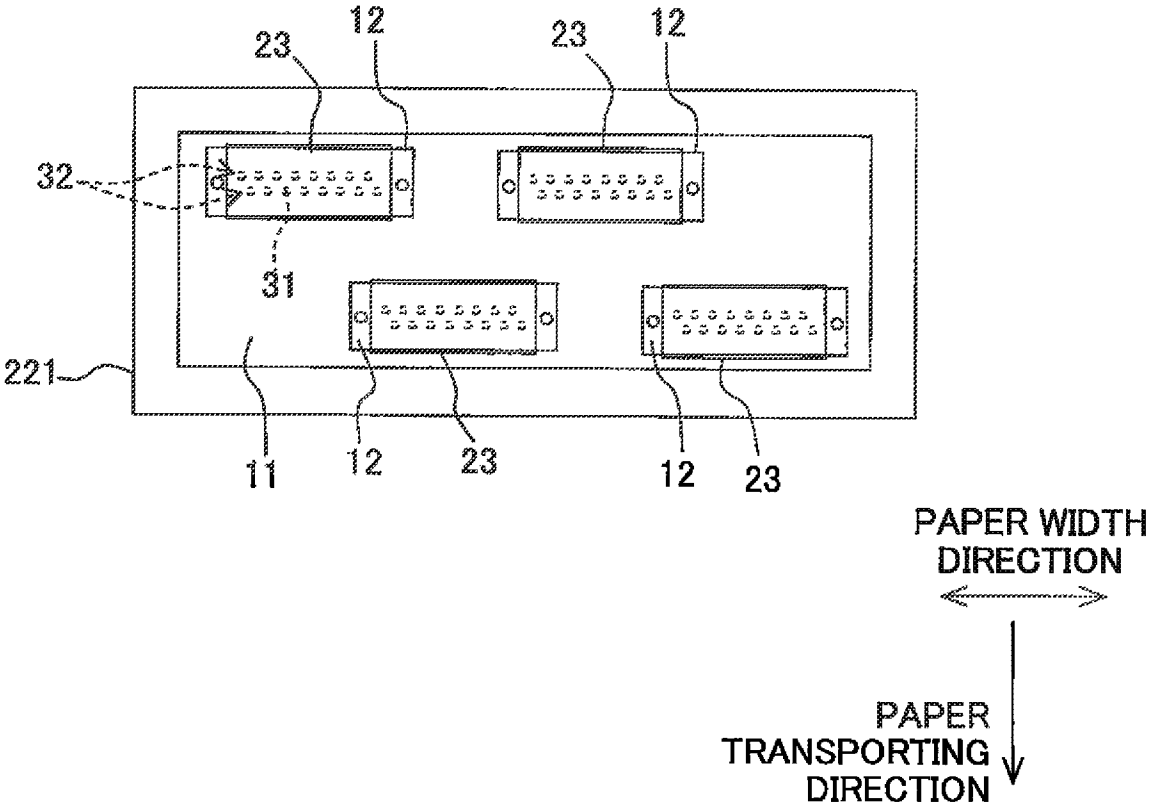
FIG. 10 is a plane view of a head unit in accordance with an eighth modification.

Further, the present teaching is also not limited to the arrangement of sandwiching the head holding plate 11 from two directions. In an eighth modification as shown in FIG. 10, a restriction member 221 is provided to enclose the entire circumference of the edge of the head holding plate 11, in any one of the head units of the first, second and third embodiments. In this case, the head holding plate 11 under expansion due to temperature rise is curved definitely because it cannot extend either in the paper width direction or in the paper feeding direction.

Further, in the above examples, the plurality of ink-jet heads 12 are fixed on the approximately rectangular head holding plate 11 so that the longitudinal direction thereof is substantially parallel to the paper width direction. However, the present teaching is not limited to such configuration.

Figure 11A:
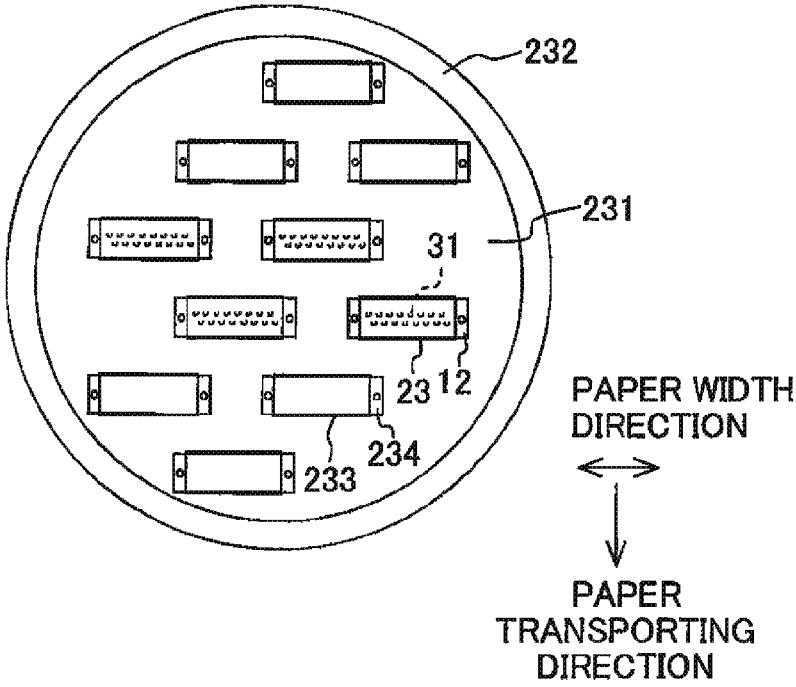
FIG. 11A is a plane view of a head unit in accordance with a ninth modification.

In a ninth modification as shown in FIG. 11A, a head holding plate 231 is an approximately circular plate-like member, and the four ink-jet heads 12 are arranged in the approximately central portion of the circular head holding plate 231. Further, a restriction member 232 encloses the entire circumference of the edge of the head holding plate 231.

Further, in upper and lower regions of the head holding plate 231 in FIG. 11A, a plurality of through holes 233 are formed into almost the same shape as the through holes 23, and a plurality of dummy heads 234 are provided to correspond to the plurality of through holes 233. The plurality of dummy heads 234 have the same structure as the ink-jet heads 12, but are not connected to the ink cartridge 35 (see FIG. 1) and thus do not jet inks.

Here, the dummy heads 234 have the same structure as the ink-jet heads 12 and, similar to the ink-jet heads 12, they each include a plurality of nozzles 31. However, in FIG. 11A, illustration of the nozzles 31 is omitted for the dummy heads 234 such that the ink-jet heads 12 may easily be distinguished from the dummy heads 234.

In this case, the restriction member 232 encloses the entire circumference of the edge of the approximately circular head holding plate 231. When the head holding plate 231 expands due to temperature rise, the head holding plate 231 is curved under a concentric deformation about the center thereof. Therefore, it is easy to apprehend the amount of displacement in each part of the head holding plate 231. Therefore, it is easy to apprehend to what degree the position of each nozzle 31 is displaced due to the curvature of the head holding plate 231, and thereby it is possible to easily adjust the aforementioned jet timing of the inks from the nozzles 31, and the like.

Further, in the ninth modification, the plurality of through holes 233 are formed in the approximately circular head holding plate 231 outside of the region in which the ink-jet heads 12 are arranged and, furthermore, the plurality of dummy heads 234 are provided to correspond to the through holes 233. Therefore, it is possible to uniformly form the through holes 23 and the through holes 233 in the head holding plate 231 while uniformly arranging the ink-jet heads 12 and the dummy heads 234 thereon. Hence, the head holding plate 231 is definitely to be curved wider a concentric deformation about its center.

Figure 11B:
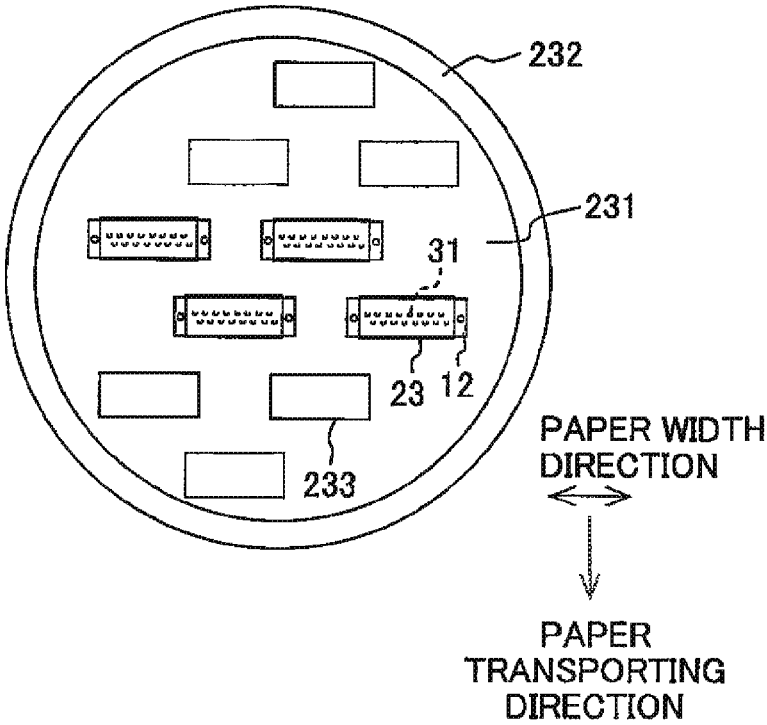
FIG. 11B is a plane view of a head unit in accordance with a tenth modification.

Further, in the ninth modification, the plurality of through holes 233 are formed in the head holding plate 231 and, furthermore, the plurality of dummy heads 234 are provided to correspond to the plurality of through holes 233. However, the present teaching is not limited to such configuration. For example, in a tenth modification as shown in FIG. 11B, the plurality of through holes 233 are formed in the head holding plate 231, but no dummy heads 234 are provided to correspond to the through holes 233. In this case, the through holes 23 and the through holes 233 are also uniformly formed in the head holding plate 231. Therefore, even though the dummy heads 234 are not provided, the head holding plate 231 is still curved approximately under a concentric deformation about its center.

Further, the through holes 233 may as well not be formed. In this case, although the through holes 23 are formed non-uniformly in the head holding plate 231, because the head holding plate 231 is approximately circular, it is still curved approximately under a concentric deformation about its center.

Further, in the above examples, although the head holding plate 11 under expansion due to temperature rise is curved to be convex upward, the head holding plate 11 under expansion due to temperature rise may as well be, on the contrary, curved to be convex downward (convex toward the side along the ink jet direction (the side along the specified direction)).

If a short distance is especially preferable between the nozzles 31 and the recording paper P such as when the printer 1 carries out printing at high image quality, e.g., photographic printing and the like, then it is possible to prevent increasing the distance between the nozzles 31 and the recording paper P by curving the head holding plate 11 to be convex downward.

Then, in order to curve the head holding plate 11 to be convex downward under expansion due to temperature rise, in the first embodiment for example, the high expansion member 21 can be arranged on the lower surface of the head holding plate 11. Alternatively, in the second embodiment, the recesses 102 can be formed in the upper surface of the head holding plate 11. Further, in these cases, because the distance between the nozzles 31 and the recording paper P becomes shorter due to the curvature of the head holding plate 11, it is possible to correct the ink landing position by delaying the jet timing of the inks from the nozzles 31 as compared with the ease of not carrying out correction.

Further, in the above examples, although the plurality of ink-jet heads are aligned along the paper width direction, the arrangement of the plurality of ink-jet heads is not limited to such configuration.

Figure 12:
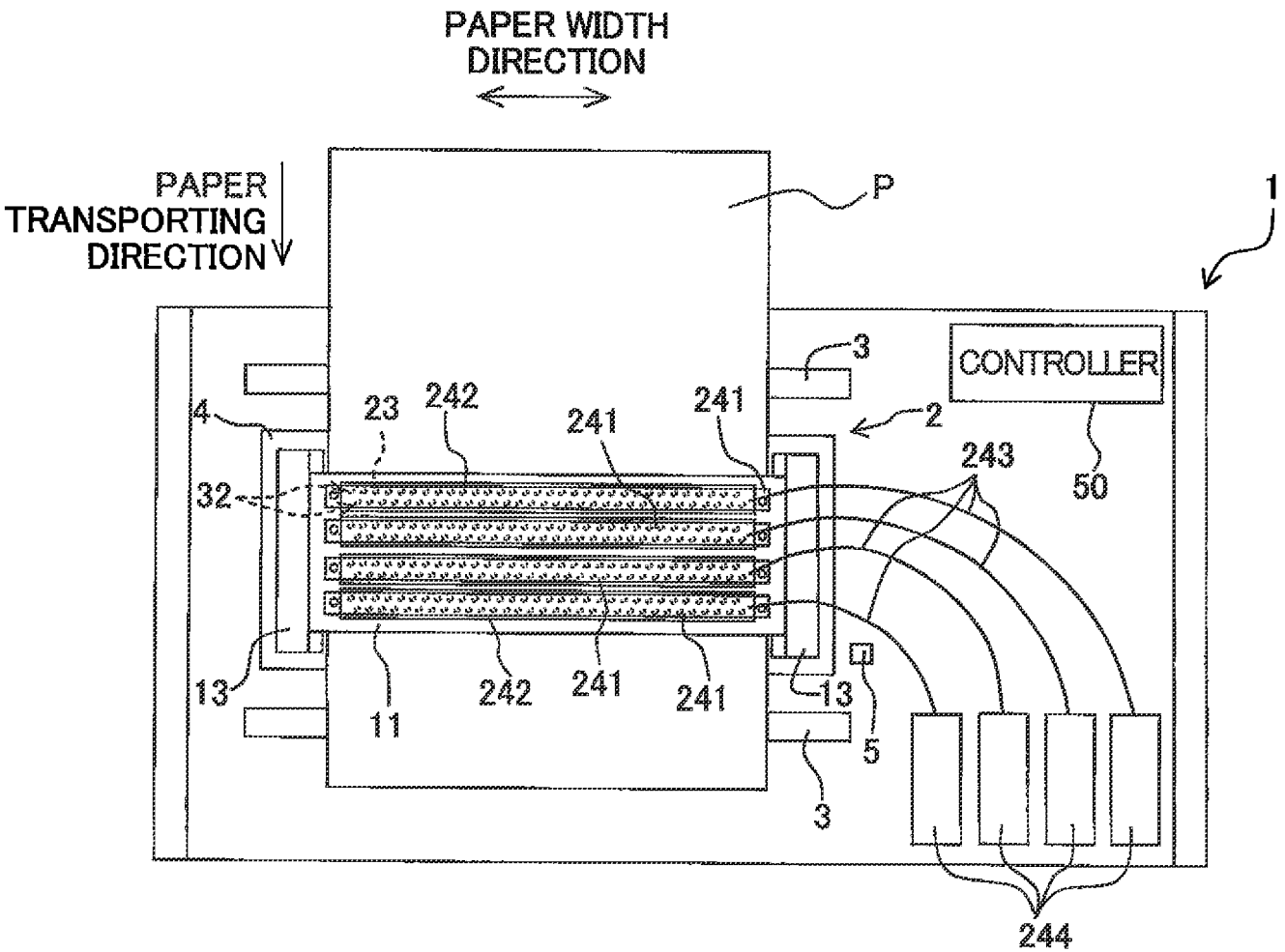
FIG. 12 is a view corresponding to FIG. 1 in accordance with an eleventh modification.

In an eleventh modification as shown in FIG. 12, four ink-jet heads 241 are arranged on the upper surface of the head holding plate 11. The four ink-jet heads 241 are, in analogy with the ink-jet heads 12 (see FIG. 1), aligned in a zigzag pattern in the paper width direction such that the plurality of nozzles 31 forms two nozzle arrays respectively. However, differing from the ink-jet heads 12, the two nozzle arrays extend over approximately the entire length of the recording paper P in the paper width direction. Further, these four ink-jet heads 241 are aligned along the paper feeding direction and, corresponding to this, four through holes 242 are formed in the head holding plate 11 to align in the paper feeding direction and extend over approximately the entire length of the recording paper P in the paper width direction.

The four ink-jet heads 241 are connected to four ink cartridges 244 through four tubes 243. The ink cartridges 244 are filled with inks of black, yellow, cyan and magenta, respectively, in the order of their arrangement from the right side in FIG. 12. The ink cartridges 244 supply the filled inks to the ink-jet heads 241 through the tubes 243, respectively. Then, the four ink-jet heads 241 jet the inks of black, yellow, cyan and magenta from the nozzles 31, respectively, in the order of their arrangement from the upper side in FIG. 12.

In this case, if, by assumption, the head holding plate 11 has extended in the paper width direction under expansion due to temperature rise, then because the extension amount along the paper width direction is different in each portion of the head holding plate 11, the displacement amount along the paper width direction differs from one another among the ink-jet heads 241. As a result, in the paper width direction, the ink landing position of each color mutually deviates on the recording paper P.

However, in the eleventh modification, because the head holding plate 11 is curved under expansion due to temperature rise, the deviation of the nozzles 31 among the ink-jet heads 241 is still diminished in the paper width direction. Thereby, it is possible to reduce the deviation of the ink landing position of each color on the recording paper P.

Figure 13:
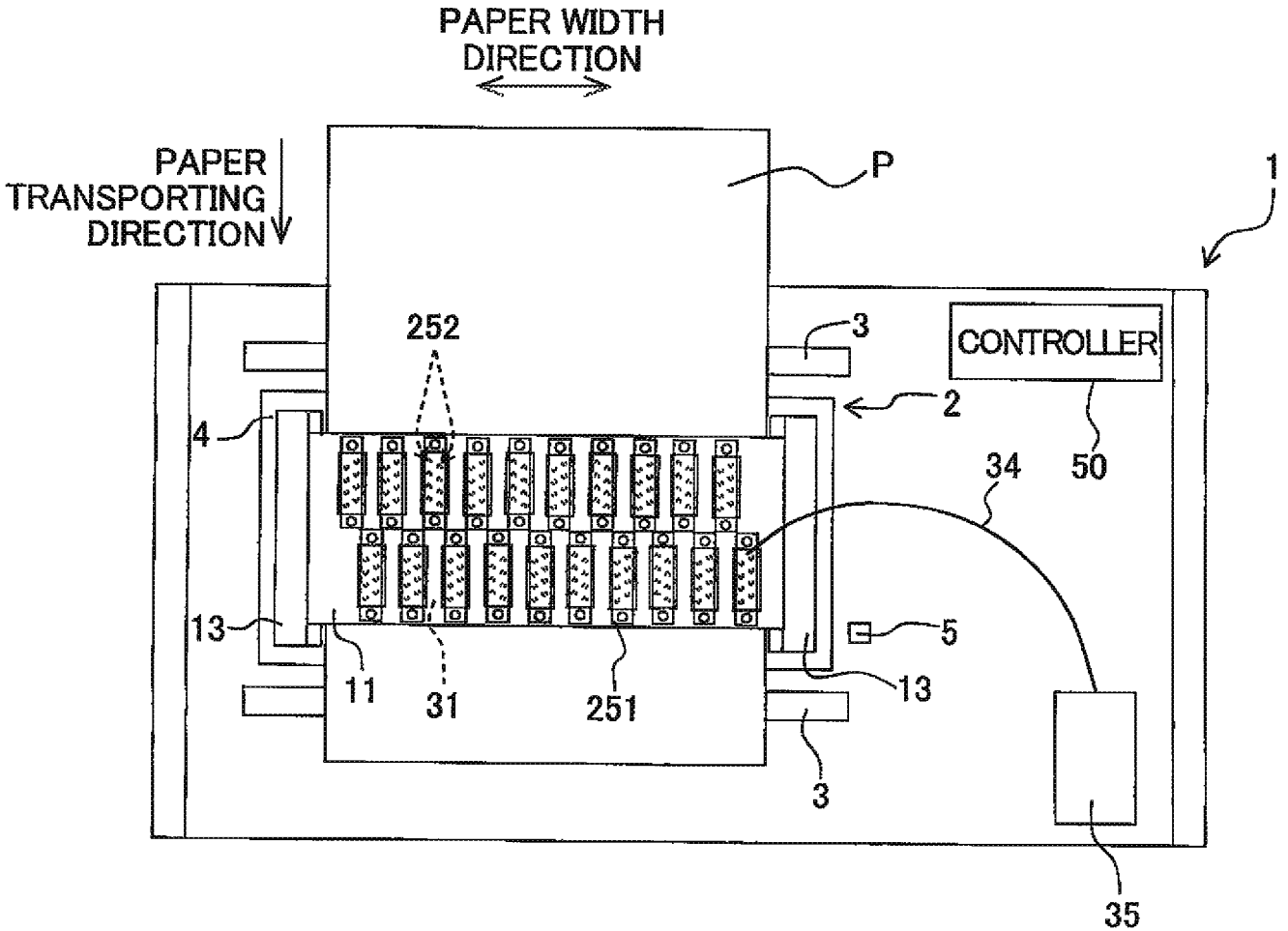
FIG. 13 is a view corresponding to FIG. 1 in accordance with a twelfth modification.

Further, in the above examples, the plurality of nozzles 31 of each ink-jet head are aligned along the paper width direction perpendicular to the paper feed direction, and the nozzle array direction is thus substantially parallel to the paper width direction. However, the present teaching is not limited to such configuration. In a twelfth modification as shown in FIG. 13, a plurality of ink-jet heads 251 are aligned in a zigzag pattern along the paper width direction. Then, the nozzles 31 of each of the ink-jet heads 251 are aligned along the paper feeding direction (a predetermined one direction) to form two nozzle arrays 252. That is, the nozzle array direction is parallel to the paper feeding direction. Further, in the twelfth modification, although the plurality of ink-jet heads 251 are connected individually to the ink cartridge 35 through the respective tubes 34, in order to make the figure easy to see, only one of these tubes 34 is shown in FIG. 13.

In this case, if, by assumption, the head holding plate 11 has extended in the paper width direction under expansion due to temperature rise, then the nozzles 31 are subjected to deviation among the ink-jet heads 251 in the paper width direction. In the twelfth modification, however, because the head holding plate 11 is curved to be convex upward under expansion due to temperature rise, it is still possible to diminish the deviation of the nozzles 31 among the ink-jet heads 251 in the paper width direction.

Further, the plurality of nozzles 31 is not to be necessarily aligned either along the paper feeding direction or along the paper width direction. For example, they may as well be aligned along one predetermined direction intersecting both the paper feeding direction and the paper width direction. Further, in the above embodiments and modifications, a nozzle plate is provided for each ink-jet head to constitute the nozzle surfaces of the plurality of ink-jet heads. However, the present teaching is not necessarily limited to such configuration. The nozzle plate may as well be provided in common for some or all of the ink-jet heads to constitute the nozzle surface or surfaces of the plurality of ink-jet heads. Further, The number of the ink-jet heads is not necessarily limited to four, and arbitrary number of ink-jet heads can be held by the head holding plate. For example, as shown in FIG. 13, not less than five ink-jet heads can be held by the head holding plate. Alternatively, not more than three ink-jet heads can be held by the head holding plate.

Further, in the above examples, the printer 1 includes a restriction member or members which curves or curve the head holding plate under expansion due to temperature rise in a direction perpendicular to the nozzle surfaces by restricting the head holding plate from extension in a direction perpendicular to the paper feeding direction, and a directing mechanism which defines the curvature of the head holding plate to be convex toward the side along a specified direction perpendicular to the nozzle surfaces, so as to displace the head holding plate upward or downward by curving the same. However, the present teaching is not limited to such configuration. For example, the head holding plate can be tilted by rotating the head holding plate so that the head holding plate is displaced upward or downward, when the head holding plate expands due to temperature rise.

Further, the above explanations were made with an example of applying the present teaching to a printer including ink-jet heads which jet inks from nozzles. However, the present teaching is not limited to this application but is applicable to liquid jetting apparatuses other than printers which jet liquids other than inks.

What is claimed is:

1. A liquid jetting apparatus which jets a liquid onto a medium, comprising:

a plurality of liquid jetting heads each of which has a nozzle surface in which a plurality of nozzles are formed to align in one direction;

a holding member which is configured to hold the plurality of liquid jetting heads in a state of being arranged along one plane;

a transporting mechanism which is configured to transport the medium in a transporting direction along the one plane; and a displacement mechanism which is configured to displace the holding member in a specified direction which is one side in a direction intersecting the nozzle surfaces by curving the holding member or by rotating the holding member, under a condition that the holding member extends due to temperature change on the one plane in an intersecting direction intersecting the transporting direction.

2. The liquid jetting apparatus according to claim 1, wherein the displacement mechanism includes: a restriction member arranged to sandwich the holding member from the intersecting direction and configured to restrict the holding member from extension in the intersecting direction so that the holding member curves in the direction intersecting the nozzle surfaces, under a condition that the temperature of the holding member rises; and a directing mechanism configured to determine a direction of a curve of the holding member so that the holding member convexly curve toward a side along the specified direction.

3. The liquid jetting apparatus according to claim 2, wherein the directing mechanism includes at least one of a high expansion member which has a linear expansion coefficient higher than that of the holding member and is adhered on a surface of the holding member on the side along the specified direction, and a low expansion member which has a linear expansion coefficient lower than that of the retention member and is agglutinated on a surface of the retention member on the opposite side against the specified direction.

4. The liquid jetting apparatus according to claim 2, wherein the directing mechanism includes at least one of a recess formed in a surface of the holding member on the opposite side against the specified direction, and a projection formed on a surface of the holding member on the side along the specified direction.

5. The liquid jetting apparatus according to claim 2, wherein the directing mechanism includes: a fixation member which is configured to fix the holding member, which is arranged on the side along the specified direction of the holding member to face the retention member, and in which a through hole is formed to extend in a direction perpendicular to the nozzle surfaces; and a rod-like member which is arranged to pass through the through hole of the fixation member and configured to be movable along the through hole, the rod-like member having a rod portion of which one end is fixed to the holding member and a head portion which is larger than the through hole in diameter and provided on the other end of the rod portion to contact with a surface of the fixation member on the opposite side to the holding member.

6. The liquid jetting apparatus according to claim 2, wherein the restriction member is arranged to enclose an entire circumference of an edge portion of the holding member to restrict the holding member from extension along all directions parallel to the nozzle surfaces.

7. The liquid jetting apparatus according to claim 6, wherein the holding member is substantially circular as viewed from a direction perpendicular to the nozzle surfaces.

8. The liquid jetting apparatus according to claim 2, further comprising: a supporting member arranged to face the nozzle surfaces of the plurality of liquid jetting heads so as to support the medium of sheet-shape from the opposite side to the nozzle surfaces, and a curvature mechanism which curves a support surface of the supporting member supporting the medium to be convex toward the side along the specified direction in conformity to the curvature of the holding member.

9. The liquid jetting apparatus according to claim 1, further comprising: a temperature sensor which is configured to detect a temperature of the holding member, and a jet timing adjustment mechanism which is configured to adjust a jet timing of the liquid jetted from the plurality of nozzles based on the temperature detected by the temperature sensor.

10. The liquid jetting apparatus according to claim 1, wherein the specified direction is the opposite direction to a jetting direction of the liquid jetted from the plurality of nozzles.

11. The liquid jetting apparatus according to claim 1, wherein the intersecting direction is substantially parallel to an alignment direction of the plurality of liquid jetting heads.

* * * * *